US005469766A

United States Patent [19]

Hodges

[11] Patent Number: 5,469,766

[45] Date of Patent: Nov. 28, 1995

[54] ADJUSTABLE SPANNER WRENCH

[76] Inventor: Joseph M. Hodges, 891 Bennett Rd., Quincy, Mich. 49082

[21] Appl. No.: 314,091

[22] Filed: Sep. 28, 1994

[51] Int. Cl.[6] ..... B25B 7/02; B25B 7/12

[52] U.S. Cl. ..... 81/367; 81/423; 81/424.5; 81/176.3

[58] Field of Search ..... 81/367, 418–424, 81/424.5, 426.5, 176.1, 176.15, 176.2, 176.3, 461; 269/259–261, 271, 272, 279, 280, 283, 284

[56] References Cited

U.S. PATENT DOCUMENTS 449,725 4/1891 Bales ..... 81/300
2,542,728 2/1951 Thoms ..... 81/176.3 X
4,697,483 10/1987 Rodgers ..... 81/424 X

*Primary Examiner*—D. S. Meislin

[57] ABSTRACT

An adjustable spanner wrench comprising of a pair of handle halves, the handle halves including a first handle half and a second handle half, the first handle half being provided with an interior channel along its length. Jaws in the form of two C-shaped arms, the C-shaped arms each having an outboard extent with an aperture therethrough, each C-shaped arm having an inboard extent with an aperture and an associated rivet coupling the outboard ends of the handle halves to the inboard extents of the arms. A pivotable clip having a free end and a pivot end pivotally secured to each outboard end of each C-shaped arm and a semicircular recess at its free end, the semicircular recess adapted to be moved in position concentric with its associated aperture for contacting the groove of the pin received in an aperture.

5 Claims, 4 Drawing Sheets

ADJUSTABLE SPANNER WRENCH

BACKGROUND OF THE INVENTION

1. Field of the Invention

The present invention relates to an adjustable spanner wrench and more particularly pertains to intalling or removing spaced spanner nuts with a wrench having adjustment capabilities to function regardless of the spacing between the spanner nuts.

2. Description of the Prior Art

The use of wrenches of a wide variety of designs and configurations for a wide variety of purposes is known in the prior art. More specifically, wrenches of a wide variety of designs and configurations for a wide variety of purposes heretofore devised and utilized for the purpose of grasping hardware of various designs and configurations through wrenches of various designs and configurations are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,212,859 to Hagerty a removal tool for snap rings and the like.

U.S. Pat. No. 5,174,177 to Jeromson discloses reversible snap ring pliers.

U.S. Pat. No. 4,689,865 to Chamblee discloses a snap ring tool.

U.S. Pat. No. 4,156,959 to Weisenburger discloses an expander device.

U.S. Pat. No. 3,501,827 to Munse discloses a tool for assembling spring metal C-clips to panels.

In this respect, the adjustable spanner wrench according to the present invention substantially departs from the conventional concepts and designs of the prior art, and in doing so provides an apparatus primarily developed for the purpose of intalling or removing spaced spanner nuts with a wrench having adjustment capabilities to function regardless of the spacing between the spanner nuts.

Therefore, it can be appreciated that there exists a continuing need for new and improved adjustable spanner wrench which can be used for intalling or removing spaced spanner nuts with a wrench having adjustment capabilities to function regardless of the spacing between the spanner nuts. In this regard, the present invention substantially fulfills this need.

SUMMARY OF THE INVENTION

In view of the foregoing disadvantages inherent in the known types of wrenches of a wide variety of designs and configurations for a wide variety of purposes now present in the prior art, the present invention provides an improved adjustable spanner wrench. As such, the general purpose of the present invention, which will be described subsequently in greater detail, is to provide a new and improved adjustable spanner wrench and method which has all the advantages of the prior art and none of the disadvantages.

To attain this, the present invention essentially comprises a pair of handle halves, the handle halves including a first handle half having an inboard end and an outboard end, the second handle half having an inboard end and an outboard end, the first handle half being provided with an interior channel along its length and an internally threaded axial aperture at its inboard end. Jaws in the form of two C-shaped arms, the C-shaped arms each having an outboard extent with an aperture therethrough for receiving a grooved pin, each C-shaped arm having an inboard extent with an aperture and an associated rivet coupling the outboard ends of the handle halves to the inboard extents of the arms. An adjustment link having a first end received in the recess of the first handle half and a second end pivotally secured to the second handle half whereby movement of the first end of the adjustment link will vary the position of the outboard end of the second handle half and one of the C-shaped arms with respect to the other C-shaped arm. An adjustment bolt with a threaded exterior surface threadedly received axially in the threaded aperture of the first handle half with an adjustment knob exterior of the first handle half adjacent to the inboard end, the adjustment nut having an outboard end operatively coupled to the first end of the adjustment link to vary its position within the first handle half. A pin positionable in each aperture, each pin having a groove at one end and a flat axial projection at its other end. A pivotable clip having a free end and a pivot end pivotally secured to each outboard end of each C-shaped arm and a semicircular recess at its free end, the semicircular recess adapted to be moved in position concentric with its associated aperture for contacting the groove of the pin received in an aperture.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable spanner wrench which have all the advantages of the prior art wrenches of a wide variety of designs and configurations for a wide variety of purposes and none of the disadvantages.

It is another object of the present invention to provide a new and improved adjustable spanner wrench which may be easily and efficiently manufactured and marketed.

It is further object of the present invention to provide a new and improved adjustable spanner wrench which are of durable and reliable constructions.

An even further object of the present invention is to provide a new and improved adjustable spanner wrench which are susceptible of a low cost of manufacture with regard to both materials and labor, and which accordingly are then susceptible of low prices of sale to the consuming public, thereby making such adjustable spanner wrench economically available to the buying public.

Still yet another object of the present invention is to provide a new and improved adjustable spanner wrench which provide in the apparatuses and methods of the prior art some of the advantages thereof, while simultaneously overcoming some of the disadvantages normally associated therewith.

Still another object of the present invention is to intall or remove spaced spanner nuts with a wrench having adjustment capabilities to function regardless of the spacing between the spanner nuts.

Lastly, it is an object of the present invention to provide a new and improved adjustable spanner wrench comprising of a pair of handle halves, the handle halves including a first handle half and a second handle half, the first handle half being provided with an interior channel along its length. Jaws in the form of two C-shaped arms, the C-shaped arms each having an outboard extent with an aperture therethrough, each C-shaped arm having an inboard extent with an aperture and an associated rivet coupling the outboard ends of the handle halves to the inboard extents of the arms. A pivotable clip having a free end and a pivot end pivotally secured to each outboard end of each C-shaped arm and a semicircular recess at its free end, the semicircular recess adapted to be moved in position concentric with its associated aperture for contacting the groove of the pin received in an aperture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
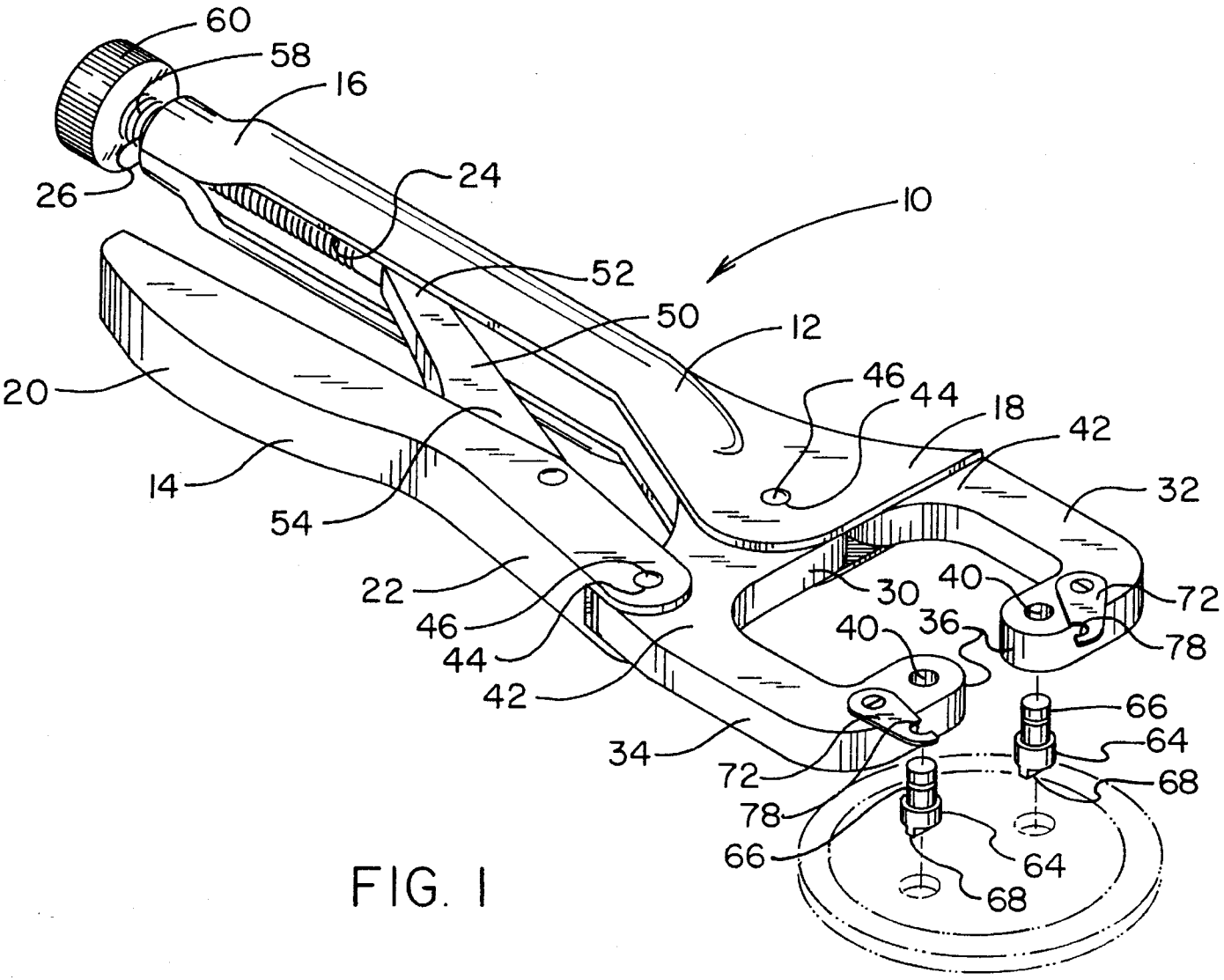
FIG. 1 is a perspective illustration of the preferred embodiment of the adjustable spanner wrench constructed in accordance with the principles of the present invention.
Figure 2:
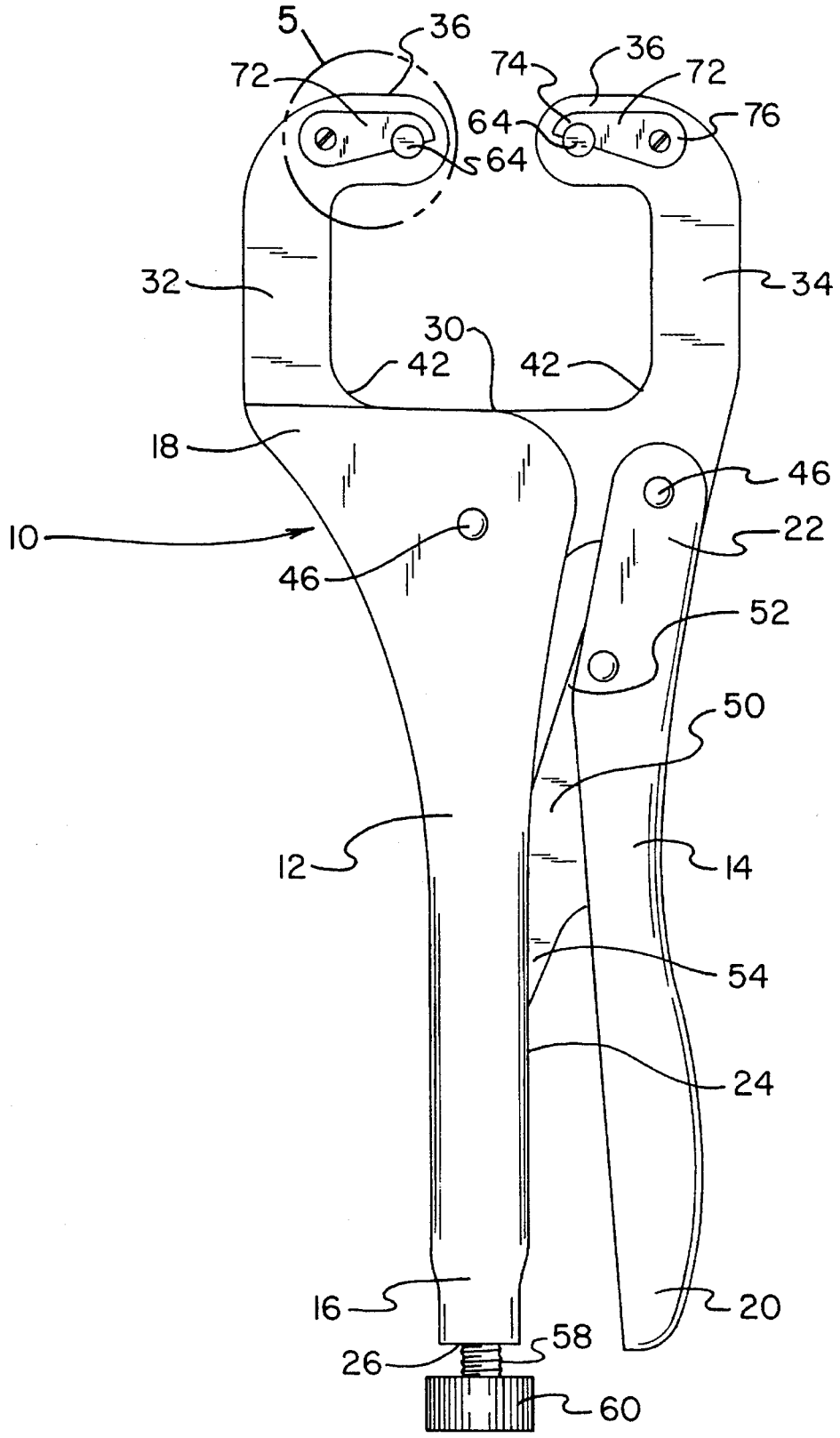
FIG. 2 is a front elevational view of the wrench shown in FIG. 1.
Figure 3:
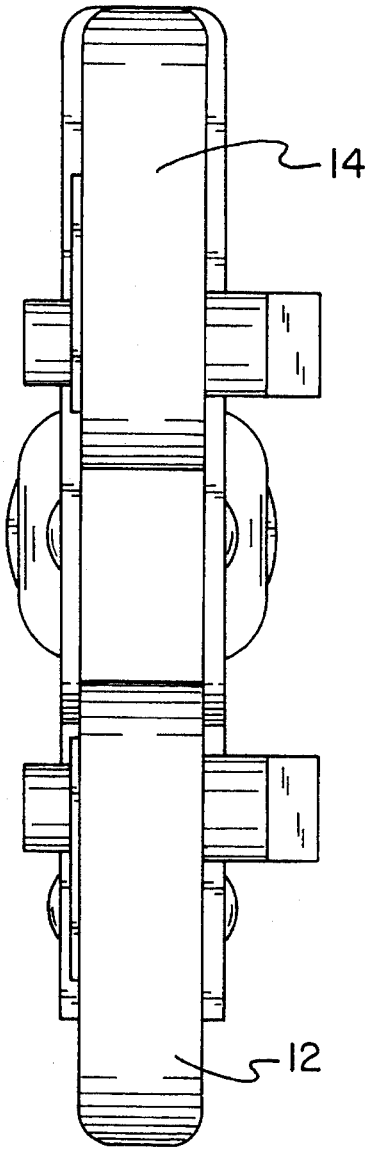
FIG. 3 is a top elevational view of the wrench shown in FIGS. 1 and 2.
Figure 4:
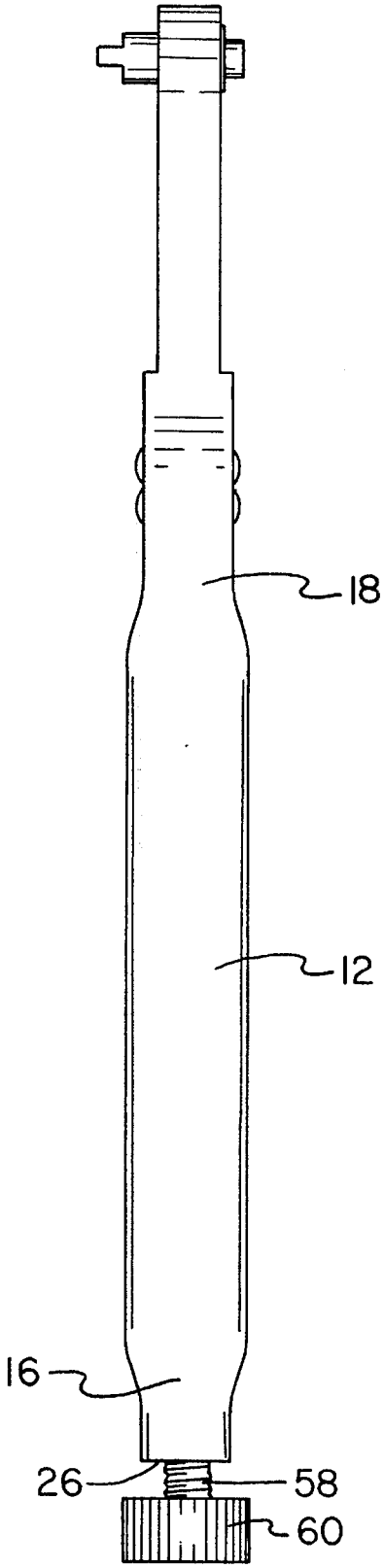
FIG. 4 is a side elevational view of the wrench shown in FIGS. 1, 2 and 3.
Figure 5:
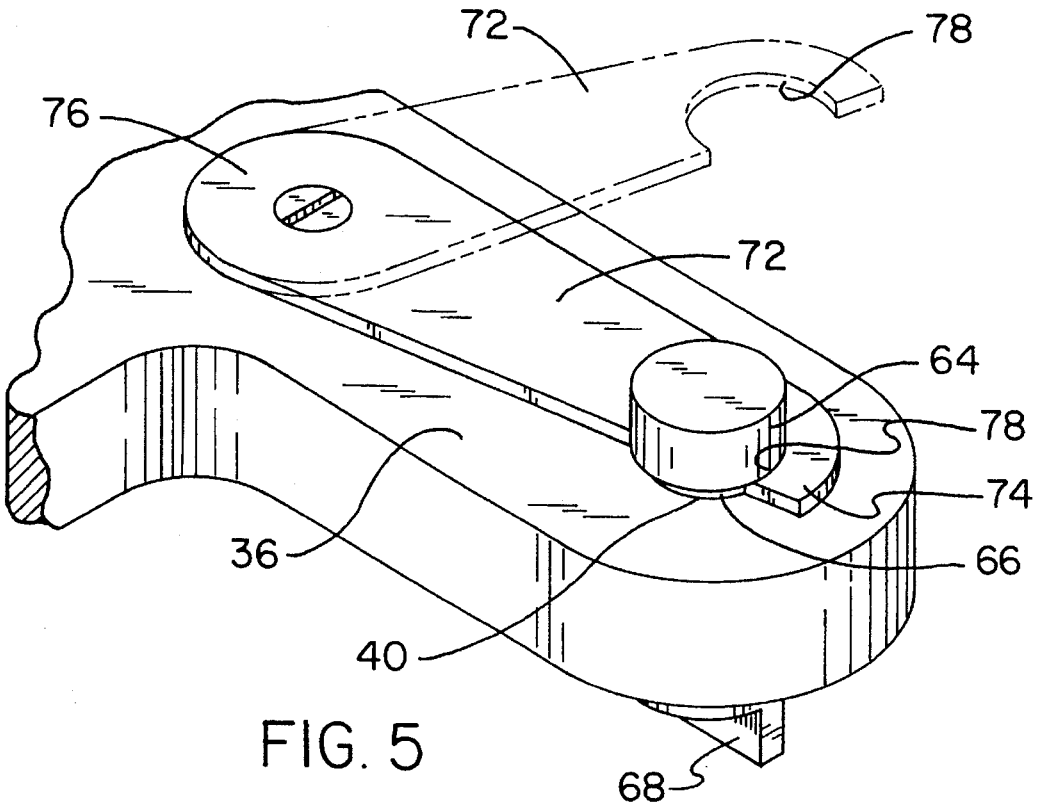
FIG. 5 is a perspective view of one portion of the wrench shown in the prior Figures and illustrating its coupling to a grooved pin.
Figure 6:
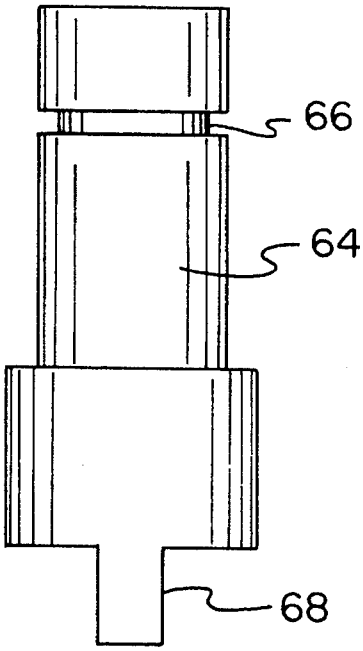
FIG. 6 is a side elevational view of the grooved pin shown in FIG. 5.
Figure 7:
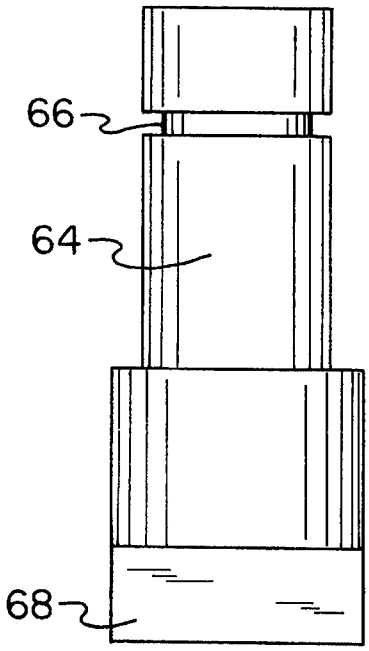
FIG. 7 is a front elevational view of the grooved pin shown in FIGS. 5 and 6.

With reference now to the drawings, and in particular to FIG. 1 thereof, the preferred embodiment of the new and improved adjustable spanner wrench embodying the principles and concepts of the present invention and generally designated by the reference numeral 10 will be described.

The invention, the new and improved adjustable spanner wrench is comprised of a plurality of components. In their broadest context, such components include a pair of handle halves, two C-shaped arms, and adjustment link, an adjustment bolt, a plurality of pins, and plurality of pivotable clips. Such components are specifically configured and correlated with respect to each other so as to attain the desired objective.

The central component of the system 10 of the present invention is a pair of handle halves. The handle halves include a first handle half 12 and a second handle half 14. The first handle half has an inboard end 16 and an outboard end 18. Similarly, the second handle half has an inboard end 20 and an outboard end 22. The first handle half is provided with an interior channel 24 along its axial length. It also has an internally threaded axial aperture 26 at its inboard end.

In association with the handle halves are jaws 30. The jaws are in the form of two C-shaped arms 32 and 34. The C-shaped arms each have an outboard extent 36 with an aperture 40 therethrough. The aperture is for receiving a grooved pin as will be described hereinafter. Each C-shaped arm has an inboard extent 42. The inboard extent 42 of arm 32 is fixed to the outboard end 18 of handle half 12. A coupling aperture 44 is provided on each outboard end 18, 22 of each arm. A rivet 46 is disposed within each aperture 44 and extended through the inboard extent 42 of arm 34. The rivets 46 thereby pivotally couple arm 34 to the outboard end 18 of handle half 12 and the outboard end 22 of handle half 14.

In association with the handle halves is an adjustment link 50. The adjustment link has a first end 52 received at the recess of the first handle half. The adjustment link also has a second end 54 pivotally secured to the second handle half. In this manner, movement of the first end of the adjustment link will vary the position of the outboard end of the second handle half and one of the C-shaped arms with respect to the other of the C-shaped arms.

Adjustment is effected through an adjustment bolt 58. Such bolt has a threaded exterior surface threadedly received axially in the threaded aperture of the first handle half. The adjustment bolt also has an adjustment knob 60, preferably knurled located exterior of the first handle half adjacent to the inboard end. The adjustment nut had an outboard end operatively coupled to the first end of the adjustment link. In this manner, rotation of the adjustment bolt will effect its movement axially to vary its position within the first handle half.

Next provided is a pin 64. The pin is actually a plurality of pins, a pair, each positionable in each aperture at the outboard end of the C-shaped arm. Each pin is formed with a groove 66 at one end and a flat axial projection 68 at its other end for making a secure contact with the slots of the member to be grasped and rotated.

The last component of the system is a pair of pivotable clips 72. Each has a free end 74 and pivot end 76. The pivot end is pivotally secured to each outboard end of each C-shaped arm. In addition, a semicircular recess 78 is formed in its free end. The semicircular recess is adapted to be moved in position concentric with an associated aperture for contacting the groove of its associated pin which is received in an aperture. The clips may be rotated away from the pins to allow the pins to be removed therefrom.

The present invention is a steel tool that is used to install or remove spanner nuts. The handle is similar to that of a vice grip except that it has no spring and has an adjusting knob to modify the width of the jaw opening. The jaws take the form of two C-shaped arms which are open at the top. Holes are drilled perpendicular to and through the ends of the jaw for the purpose of holding various size pins from ⅛ to ½ to 1/16 inch increments. These pins are interchangeable and will fit different size spanner nuts. Clips that adapt to the grooves cut around the circumference of the pins at one end and are fastened to the pin holes. Each pin has a short projection similar to a standard screwdriver blade but fits into the slot of a spanner nut.

To use the present invention the proper size pins are inserted into the pin holes and secured in place with the clips. The adjustment knob is qualified for the width of the spanner nut and the pins are then inserted into the slots of the spanner nut. The tool is then activated to tighten or loosen the nut. The present invention is easy to use and is effective in performing its task.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved adjustable spanner wrench comprising, in combination:

a pair of handle halves, the handle halves including a first handle half having an inboard end and an outboard end, the second handle half having an inboard end and an outboard end, the first handle half being provided with an interior channel along its length and an internally threaded axial aperture at its inboard jaws in the form of two C-shaped arms, the C-shaped arms each having an outboard extent with an aperture therethrough for receiving a grooved pin, each C-shaped arm having an inboard extent with an aperture and an associated rivet coupling the outboard ends of the handle halves to the inboard extents of the arms;

an adjustment link having a first end received in the recess of the first handle half and a second end pivotally secured to the second handle half whereby movement of the first end of the adjustment link will vary the position of the outboard end of the second handle half and one of the C-shaped arms with respect to the other C-shaped arm;

an adjustment bolt with a threaded exterior surface threadedly received axially in the threaded aperture of the first handle half with an adjustment knob exterior of the first handle half adjacent to the inboard end, the adjustment nut having an outboard end operatively coupled to the first end of the adjustment link to vary its position within the first handle half;

a pin positionable in each aperture of the outboard extent of each arm, each pin having a groove at one end and a flat axial projection at its other end; and a pivotable clip having a free end and a pivot end pivotally secured to each outboard C-shaped arm and a semicircular recess at its free end, the semicircular recess adapted to be moved in position concentric with its associated aperture for contacting the groove of the pin received in an aperture.

2. An adjustable spanner wrench comprising of:

a pair of handle halves, the handle halves including a first handle half and a second handle half, the first handle half being provided with an interior channel along its length;

jaws in the form of two C-shaped arms, the C-shaped arms each having an outboard extent with an aperture therethrough, each C-shaped arm having an inboard extent with an aperture and an associated rivet coupling the outboard ends of the handle halves to the inboard extents of the arms; and a pivotable clip having a free end and a pivot end pivotally secured to each outboard C-shaped arm and a semicircular recess at its free end, the semicircular recess adapted to be moved in position concentric with its associated aperture for contacting a groove of a pin received in the associated aperture.

3. The apparatus as set forth in claim 2 and further including:

an adjustment link having a first end received in the recess of the first handle half and a second end pivotally secured to the second handle half whereby movement of the first end of the adjustment link will vary the position of the outboard end of the second handle half and one of the C-shaped arms with respect to the other C-shaped arm.

4. The apparatus as set forth in claim 3 and further including:

an adjustment bolt with a threaded exterior surface threadedly received in a threaded axial aperture of the first handle half with an adjustment knob exterior of the first handle half adjacent to the inboard end, the adjustment nut having an outboard end operatively coupled to the first end of the adjustment link to vary its position within the first handle half.

5. The apparatus as set forth in claim 2 and further including a pin positionable in each aperture, each pin having a groove at one end and a flat axial projection at its other end.

* * * * *